US007367736B2

(12) United States Patent
Chan

(10) Patent No.: US 7,367,736 B2
(45) Date of Patent: May 6, 2008

(54) SOLID-LIQUID TWOFOLD DAUBER

(75) Inventor: Wing Fai Chan, Kowloon (HK)

(73) Assignee: MTL Corporation Ltd., Kowloon (HK)

( * ) Notice: Subject to any disclaimer, the term of this patent is extended or adjusted under 35 U.S.C. 154(b) by 11 days.

(21) Appl. No.: 11/550,791

(22) Filed: Oct. 18, 2006

(65) Prior Publication Data

US 2007/0102443 A1 May 10, 2007

(30) Foreign Application Priority Data

Oct. 19, 2005 (CN) ..... 2005 2 0128818

(51) Int. Cl.
*B05C 1/00* (2006.01)

(52) U.S. Cl. ..... 401/17; 401/19; 401/29; 401/34

(58) Field of Classification Search ..... 401/16, 401/17, 19, 21, 23, 25, 29, 34, 37, 38, 68–70, 401/75, 82
See application file for complete search history.

(56) References Cited

U.S. PATENT DOCUMENTS 5,320,442 A * 6/1994 Yanagisawa et al. ..... 401/172
6,241,408 B1 * 6/2001 Lang ..... 401/17

* cited by examiner

*Primary Examiner*—Huyen Le
(74) *Attorney, Agent, or Firm*—Intellectual Property Law Group LLP; Otto O. Lee; Juneko Jackson

(57) ABSTRACT

The invention relates to a double-duty applicator for solid and liquid mediums, comprising a columned bearer and an outer tube combined to contain solid medium, and extending from a double-stage columned base. At the other end of said base is fixed a soft tube containing liquid medium. Said outer tube covers the outside of the bearer, with inner threads on the inner wall therein, which matches with outer threads of the bearer. The bottom end of the outer tube is fixed outside a smaller columned flange of the base through fastening slots, and a limiting mechanism is positioned between the bottom of the bearer and the base to limit the turning of the bearer. The invention adds a liquid medium applicator to the conventional solid medium applicator structure, and combines both applicator structures together, thereby making it easy to carry and use.

12 Claims, 1 Drawing Sheet

SOLID-LIQUID TWOFOLD DAUBER

CROSS-REFERENCE TO RELATED APPLICATIONS

This application claims foreign priority under 35 U.S.C. §119 to Chinese Patent Application no. 200520128818.8, filed in the People's Republic of China on Oct. 19, 2005, the entire contents of which are hereby incorporated by reference.

BACKGROUND OF THE INVENTION

1. Field of the Invention

This invention relates to an applicator, more particularly, it relates to an applicator for the combination of solid and liquid mediums.

2. Related Art

Common applicators, such as glue, lipstick and so on, are divided into two types, liquid medium and solid medium, which are commonly packaged separately for use in different circumstances. Lipsticks are used for everyday make up and skin care. The problem is that although solid lipsticks have a long-lasting effect, they are however, dry. Lip moisturizers can moisturize lips, however, it does not have a long-lasting effect. Often, both liquid lipsticks and solid lipsticks are used together, that is, applying the solid lipstick first, then applying another layer of liquid lip moisturizer, so that the lipsticks are long lasting while moisturizing the lips. However, the two types of lipsticks are packaged separately, making it inconvenient for carrying as well as using the lipsticks.

SUMMARY OF THE INVENTION

The object of the present invention is to solve the problems in the prior art, and provide an applicator with a particular structure that is for a solid and a liquid, 2-in-1, which is convenient for using and carrying.

The embodiment of the present invention provides a double-duty applicator for solid and liquid mediums, comprising a columned bearer and a outer tube combined to contain a solid medium, and extending from one end of a double-stage columned base, wherein the other end of said base is fixed to a soft tube containing a liquid medium. The outer tube covers the outside of the bearer, with inner threads on the inner wall therein, which matches with outer threads of the bearer. One end of the outer tube is fixed to the outside of a smaller columned flange of the base through connecting slots. The external diameter of said outer tube is the same as the external diameter of a larger columned flange of the base, and a limiting mechanism is positioned between the bottom of the bearer and the base to limit the turning of the bearer.

In one aspect, said limiting mechanism is a vertical core bar, with one end of said vertical core bar fixed off center on the circular shaped base, and the other end positioned across a blind hole of the bottom of the bearer, wherein said vertical core bar is clearance fit with said blind hole.

In one aspect, said limiting mechanism comprises a means having two ends, said means having screw threads on an outside surface at which both ends of said means are fixed to the base and the bottom of the bearer, respectively.

In another aspect, the external diameter of said outer tube is the same as the external diameter of a larger columned flange of the base, and a tube lid is positioned on one end of the outer tube corresponding to the base.

In another aspect of the present invention, a round head having a liquid outlet, and a another tube lid for the round head are positioned on one end of said soft tube containing liquid medium, which corresponds to the base, wherein there are screw threads on an outside surface of said round head, and the inner wall of said tube lid for the round head has screw threads which match with the threads of the round head.

In one aspect of the present invention, said soft tube containing liquid medium is made of a PP material (polypropylene) or like material.

These and other embodiments of the present invention are further made apparent, in the remainder of the present document, to those of ordinary skill in the art.

BRIEF DESCRIPTION OF THE DRAWINGS

In order to more fully describe embodiments of the present invention, reference is made to the accompanying drawing. This drawing is not to be considered limitations in the scope of the invention, but is merely illustrative.

DETAILED DESCRIPTION OF SPECIFIC EMBODIMENTS

Figure 1:
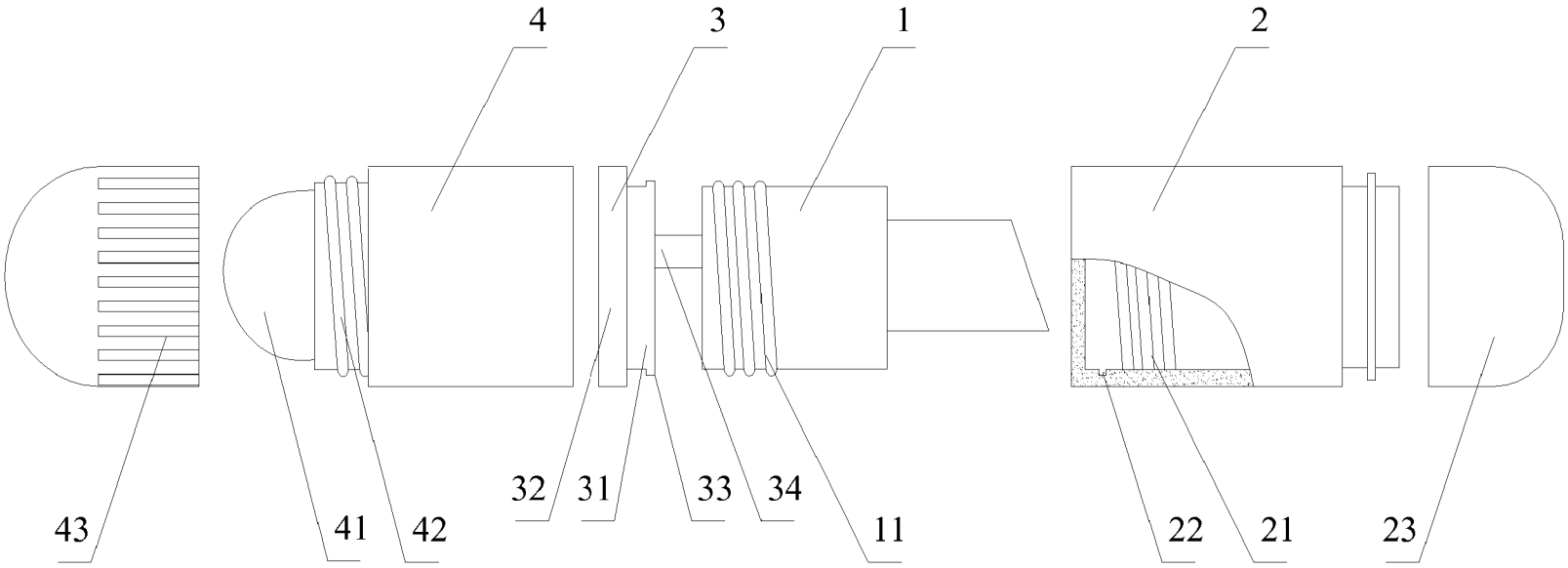
FIG. 1 is a schematic diagram of the double-duty applicator for solid and liquid mediums in accordance with an embodiment of the present invention.

The description above and below and the drawings of the present document focus on one or more currently preferred embodiments of the present invention and also describe some exemplary optional features and/or alternative embodiments. The description and drawings are for the purpose of illustration and not limitation. Those of ordinary skill in the art would recognize variations, modifications, and alternatives. Such variations, modifications, and alternatives are also within the scope of the present invention. Section titles are terse and are for convenience only.

Referring to FIG. 1, the double-duty applicator for solid and liquid mediums of the present invention, comprises a columned bearer 1, an outer tube 2 and a double-stage columned base 3. A soft tube 4 made of polypropylene material for containing liquid medium is fixed on one end of said base 3.

A solid medium is installed on the columned bearer 1, and the outer tube 2 covers the outside of said bearer 1, with screw threads 21, 11, respectively provided on the inside surface/wall of the outer tube 2 and the outside surface of bearer 1 which are matched with each other. The external diameter of a larger columned flange 32 of the double-stage columned base 3 is identical to the external diameter of said outer tube 2, while a smaller columned flange 31 having a slot protrusion, is slipped into one end of the outer tube 2 and joined to each other by connection slots 22, 33, thereby the axial movement of the outer tube 2 is limited when it is turned. A tube lid 23 is positioned on the other end of the outer tube 2. A limiting mechanism is positioned between the bottom of the bearer 1 and the base 3 to limit the turning of the bearer 1. The limiting mechanism comprises a vertical core bar 34 which is fixed at one end on the base 3, positioned off from the center of the circular area of the base 3; and a blind hole on the bottom of the bearer 1 which covers the other end of the vertical core bar 34. The vertical core bar 34 and the blind hole fit with each other through a clearance fit. The limiting mechanism can also be a means having screw threads on an outside surface wherein the two ends of said means are fixed to the base 3 and the bottom of the bearer 1, respectively.

Holding the base 3 fixed while turning the outer tube 2, or holding the outer tube 2 fixed while turning the base 3, the solid medium bearer 1 that matches with the outer tube 2 through screw threads, would normally turn relative to the base 3 due to the turning of the outer tube 2. However, the turning or rotation of the bearer 1 is limited by the limiting mechanism. Due to the effect of the matched screw threads 11, 21, this relative turning is converted to a relative shifting along the axial direction to the base 3 and the outer tube 2, therefore, changing turning directions can cause the solid medium fixed on the bearer 1 to protrude/retract from the outer tube 2.

The soft tube 4 containing a liquid medium has a round head 41 having a liquid outlet, and a tube lid 43, positioned on the end that corresponds to the base 3. There are screw threads 42 on the outside surface of the round head 41, and the screw threads on the inner wall of said tube lid 43 match with the screw threads 42.

Throughout the description and drawings, example embodiments are given with reference to specific configurations. It will be appreciated by those of ordinary skill in the art that the present invention can be embodied in other specific forms. Those of ordinary skill in the art would be able to practice such other embodiments without undue experimentation. The scope of the present invention, for the purpose of the present patent document, is not limited merely to the specific example embodiments of the foregoing description, but rather is indicated by the appended claims. All changes that come within the meaning and range of equivalents within the claims are intended to be considered as being embraced within the spirit and scope of the claims.

What is claimed is:

1. A double-duty applicator for solid and liquid mediums, comprising:

a cylindrical bearer and an outer tube surrounding an outer surface of the cylindrical bearer, wherein a solid medium is housed within both the bearer and outer tube;

a double-stage cylindrical base having a first end and a second end, at the first end protrudes a first columned flange and a second columned flange having a smaller external diameter than the first columned flange, the first end of the base positioned to contact a bottom end of the bearer;

a soft tube containing a liquid medium affixed to the second end of the base; and a limiting mechanism positioned between the bottom end of the bearer and the base to limit rotation of the bearer;

wherein said outer tube comprises an inner wall having inner threads thereon and the outer surface of the bearer having outer threads thereon, wherein the inner threads correspond to the outer threads, and wherein a bottom end of the outer tube is secured around the second columned flange of the base through slot protrusions.

2. The applicator according to claim 1, wherein said limiting mechanism is a vertical core bar having a first end and a second end, with the first end positioned across a blind hole at the bottom of the bearer and the second end fixed onto the base, wherein said vertical core bar is positioned off center in relation to the middle of the base and is clearance fit with said blind hole.

3. The applicator according to claim 2, wherein said limiting mechanism comprises a first end and a second end, and a plurality of screw threads on an outside surface of each end, wherein the first end is fixed to the bottom of the bearer and the second end is fixed to the base, respectively.

4. The applicator according to claim 3, wherein an external diameter of said outer tube is equal to an external diameter of the first columned flange, and further comprising a removable tube lid for covering one end of said applicator.

5. The applicator according to claim 3, further comprising a round head having a liquid outlet connected to the soft tube; and a removable tube lid for covering the round head; the round head comprising outer screw threads located on an outside surface of said round head, and the tube lid comprising inner screw threads located on an inner wall of the tube lid, wherein the outer screw threads correspond to the inner screw threads.

6. The applicator according to claim 5, wherein said soft tube is constructed of polypropylene material.

7. The applicator according to claim 2, wherein an external diameter of said outer tube is equal to an external diameter of the first columned flange, and further comprising a removable tube lid positioned on one end of said applicator.

8. The applicator according to claim 1, wherein an external diameter of said outer tube is equal to an external diameter of the first columned flange, and further comprising a removable tube lid positioned on one end of said applicator.

9. The applicator according to claim 1, further comprising a round head having a liquid outlet connected to the soft tube; and a removable tube lid for covering the round head; the round head comprising outer screw threads located on an outside surface of said round head, and the tube lid comprising inner screw threads located on an inner wall of the tube lid, wherein the outer screw threads correspond to the inner screw threads.

10. The applicator according to claim 9, wherein said soft tube is constructed of polypropylene material.

11. The applicator according to claim 2, further comprising a round head having a liquid outlet connected to the soft tube; and a removable tube lid for covering the round head; the round head comprising outer screw threads located on an outside surface of said round head, and the tube lid comprising inner screw threads located on an inner wall of the tube lid, wherein the outer screw threads correspond to the inner screw threads.

12. The applicator according to claim 11, wherein said soft tube is constructed of polypropylene material.

* * * * *